US006247698B1

(12) United States Patent
Twombly

(10) Patent No.: US 6,247,698 B1
(45) Date of Patent: Jun. 19, 2001

(54) WINE REGION BOARD AND CARD GAME

(76) Inventor: Susan Mabel Twombly, 150 E. 77 St., Apt. 8F, New York, NY (US) 10021

( * ) Notice: Subject to any disclaimer, the term of this patent is extended or adjusted under 35 U.S.C. 154(b) by 0 days.

(21) Appl. No.: 09/478,275

(22) Filed: Jan. 5, 2000

Related U.S. Application Data

(63) Continuation-in-part of application No. 09/188,941, filed on Nov. 10, 1998, now abandoned.

(51) Int. Cl.[7] ..... A63F 1/00

(52) U.S. Cl. ..... 273/297; 273/256; 273/278; 273/254

(58) Field of Search ..... 273/292, 236, 273/256, 278, 145 C, 297, 307, 708, 254

(56) References Cited

U.S. PATENT DOCUMENTS 2,026,082 * 12/1935 Darrow .
3,801,104 * 4/1974 Potts .
4,093,235 * 6/1978 Barry .
4,360,205 * 11/1982 Rimbold .
4,928,967 * 5/1990 Woodliff .
5,292,133 * 3/1994 Alexander .

* cited by examiner

*Primary Examiner*—Benjamin H. Layno
*Assistant Examiner*—Vishu Mendiratta
(74) *Attorney, Agent, or Firm*—Allen N. Friedman; McCarter & English LLP

(57) ABSTRACT

A board game apparatus upon which a card game is played contains a plurality of principal areas representing either a) international wine-producing continents in the world or, b) districts within a wine region depending upon whether the game version is a) international or, b) regional. Localities within the principal areas represent either a) wine regions within the international wine-producing continents of the world or, b) vineyards within the districts of the wine region. Playing cards correspond to the areas and localities on the board and also list one of four purchase prices and symbols as the object of the game is for players match and purchase the symbols for one of three winning playing card combinations. The playing cards must originate from either a) inside a first principal area e.g. Europe, or b) any other principal area(s) outside of the first principal area. Players must rid themselves of any remaining cards. Turns are two-fold: 1) players spin a spinner in order to select, discard or purchase playing cards, then 2) players cast a die which directs them to win cash by way of the "Kitty Pile" or by way of educational option cards, or to lose cash through penalty option cards.

9 Claims, 8 Drawing Sheets

WINE REGION BOARD AND CARD GAME

RELATED APPLICATIONS

This Application is a Continuation-in-Part of U.S. application Ser. No. 09/188,941 filed Nov. 10, 1998 abandoned.

FEDERALLY SPONSORED RESEARCH

Not Applicable

BACKGROUND OF THE INVENTION

1. Field of the Invention

This invention relates generally to a board game apparatus and in particular, to a board game apparatus upon which a card game is played. The present invention is intended to educate players with respect to important wine regions of the world.

The board game apparatus of the present invention is intended not only to provide an educational forum but a tactical one where all players, whether they are beginners or knowledgeable with regard to wine, have a chance at reaching the game's strategic objective. The game board apparatus in the form of a map teaches players about geographical aspects of existing wine regions while providing a platform on which to utilize the various game components. Playing cards facilitate strategic play while option cards—"Chance" and "Quiz"—teach specifics about the selected regions and the wine industry.

More and more people are becoming interested in wine, its origins and the viticultural/vinification methods employed. This game is a medium where players will learn, at the very least, something about the many aspects of the world's important wine regions. The game allows players to improve their strategy each time they play while they continue to learn facts about wine and to improve their retention.

SUMMARY OF THE INVENTION

The board game apparatus of the present invention is intended to provide a platform on which is played an engaging wine-related card game. It is also an object of the present invention to educate players with the many aspects of the wine regions of the world. Although the embodiment described herein refers to a world map containing wine-producing continents and their pertinent wine regions, the invention can also be applied to individual wine regions e.g. a map of Bordeaux, a map of Burgundy, a map of Southern Australia, etc. containing the specific region's wine districts and pertinent vineyards.

Briefly, in accordance with the present invention, there is provided a game board apparatus with a map consisting of six continents containing their respective wine regions. Playing cards, which relate to the continents and regions on the map are dealt to players and placed in the center of the board for drawing and discard purposes. The playing cards also contain one of four symbols—a star, a wine bottle, a wineglass, a bunch of grapes—that must be matched with like symbols to attain a winning playing card combination. A purchase price on the card corresponds to the symbol, as players must buy the playing cards that they intend to match together. The object of the game is for a player to assemble and purchase a winning combination of playing cards whose regions originate from either inside a major principal area e.g. the continent of Europe or any other principal areas(s) outside of the principal area e.g. any continent(s) other than Europe. Each player must also rid himself/herself of any cards remaining in his/her hand in order to win. As players purchase the desired playing cards, they mark the related wine regions on the map with colored markers provided to them prior to play.

Players collect and discard playing cards and collect and pay game currency by means of a two-step turn. As the first part of the turn, a player spins a spinner in order to follow one of four playing card instructions. The second part of a player's turn involves casting a die and then following one of three directives to gain or pay out cash by way of "Chance" and "Quiz" option cards or to gain cash through winning the "Kitty Pile"—a designated area on the game board where penalty payments are retained.

BRIEF DESCRIPTION OF DRAWINGS

More specific aspects of the present invention will become apparent from the accompanying game component illustrations in which.

DETAILED DESCRIPTION OF A PREFERRED EMBODIMENT

Figure 1A:
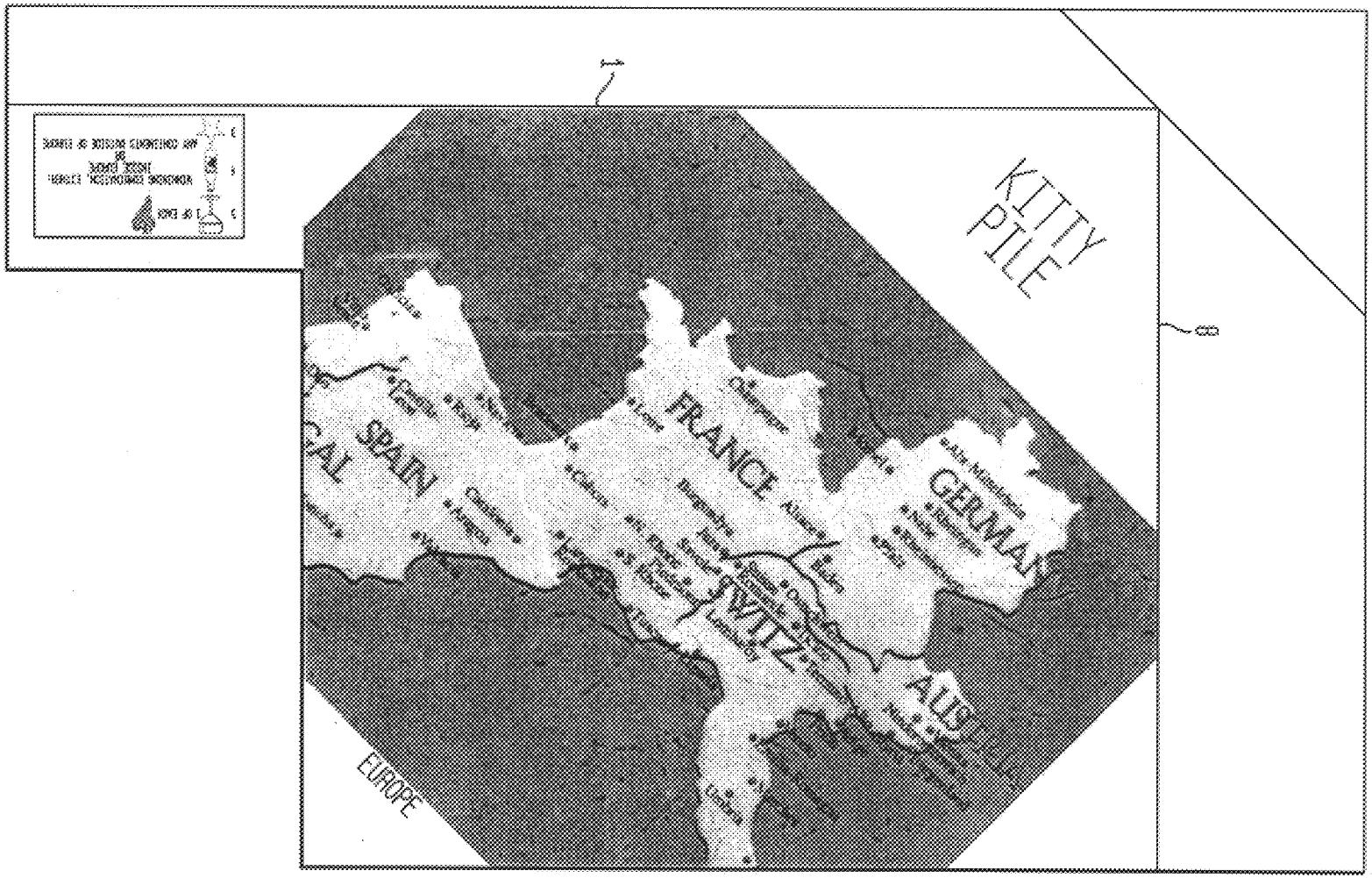
FIGS. 1A, B, C, and D are the top-left, top-right, bottom-left, and bottom-right quadrants, respectively, of a top plan view of one form of the board for the international game version inasmuch as this version is being used in the present embodiment.
Figure 1B:
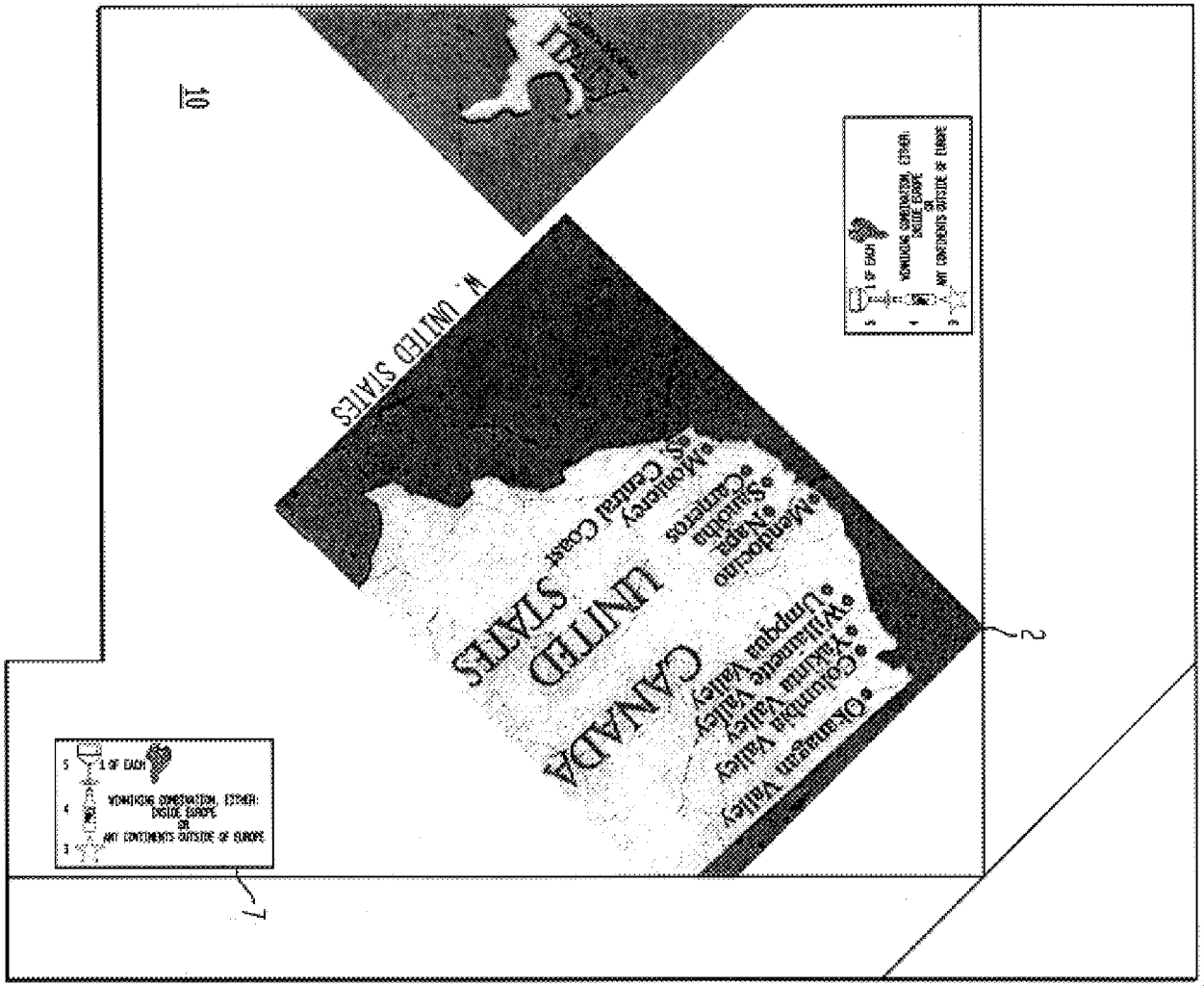
Figure 1C:
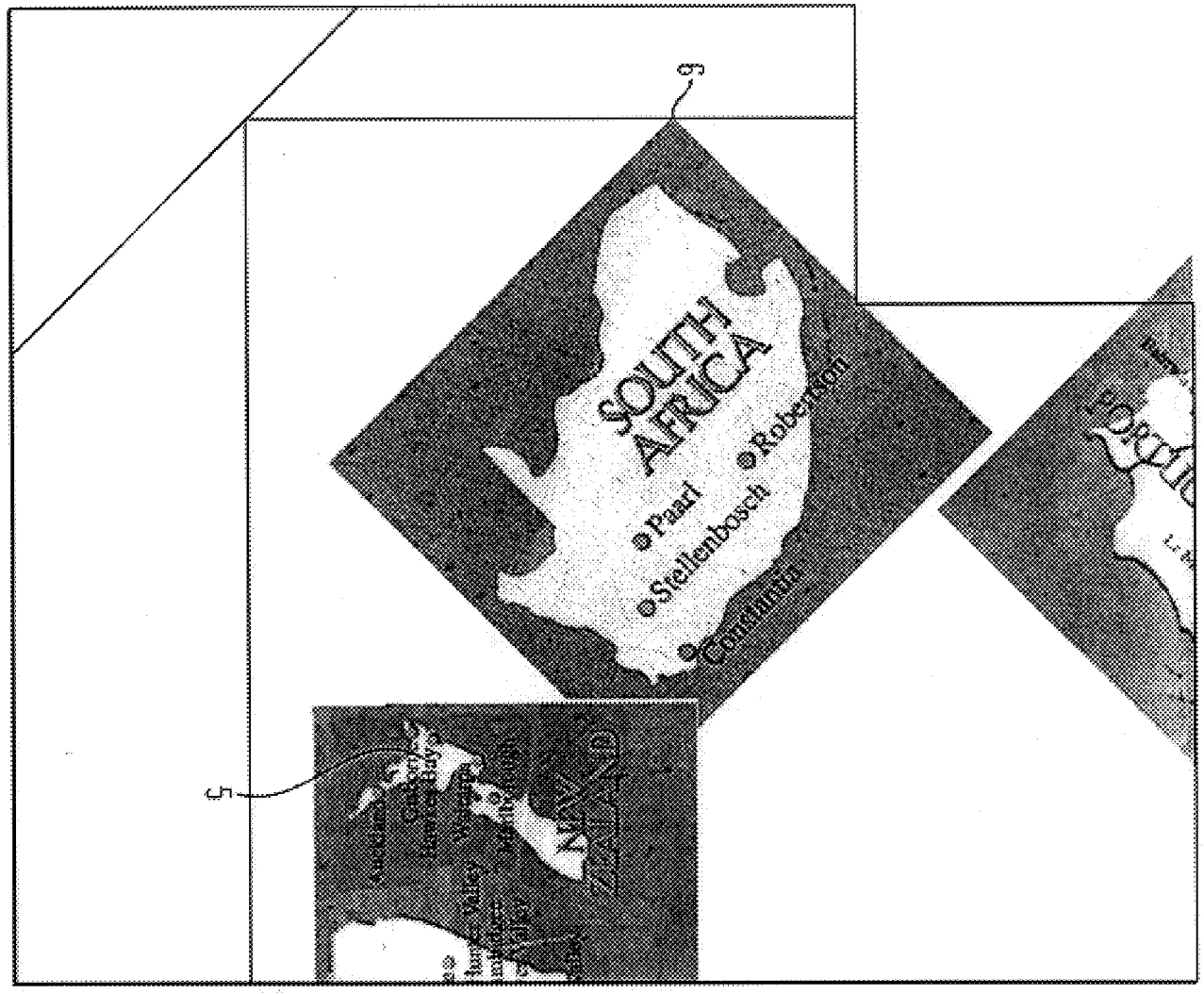
Figure 1D:
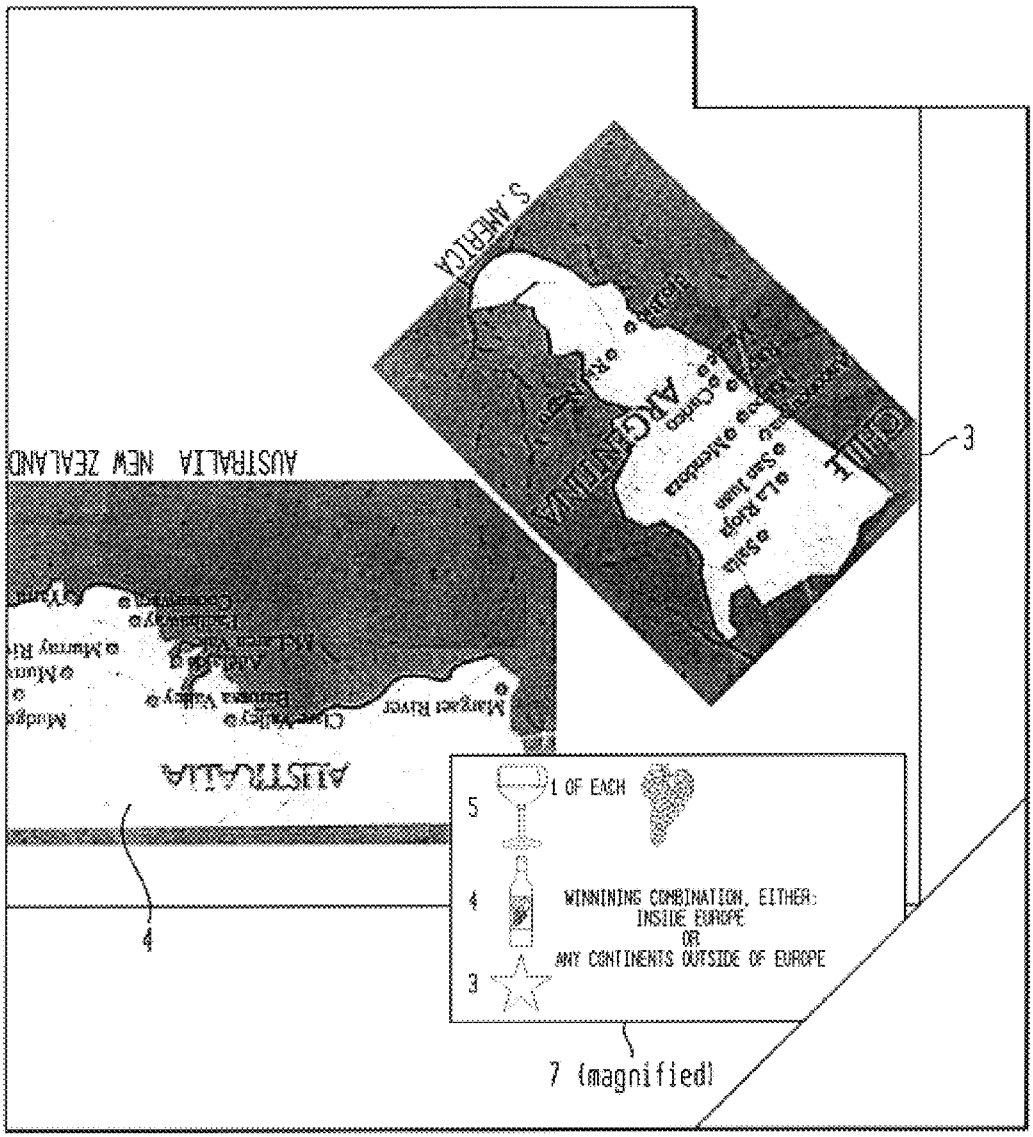

It should be made clear that, although the present invention deals with geographical aspects of certain world continents and their wine regions, other geographical areas such as a specific wine region, its districts and vineyards are considered for which forthcoming games, within the scope of the present invention, may be developed.

Referring to the drawings in which like reference numerals designate like parts throughout the several illustrations, a map (not to scale) that depicts six continents or portions thereof includes Europe 1, the Western United States 2, South America 3, Australia 4, New Zealand 5 and South Africa 6 is provided on the game board apparatus FIG. 1.

Winning playing card combination rules 7 are also posted on each side of the game board apparatus FIG. 1 and a Kitty Pile 8 space is designated for penalty payments that transpire during the course of game. The continents 1–6 on the game board apparatus FIG. 1 contain individual wine regions 9 (eighty-one in number in the present embodiment) that are named and plotted within their respective countries. There is also a central area 10 on the board FIG. 1 designated for the playing cards FIG. 2 and various other game components.

Figure 2:
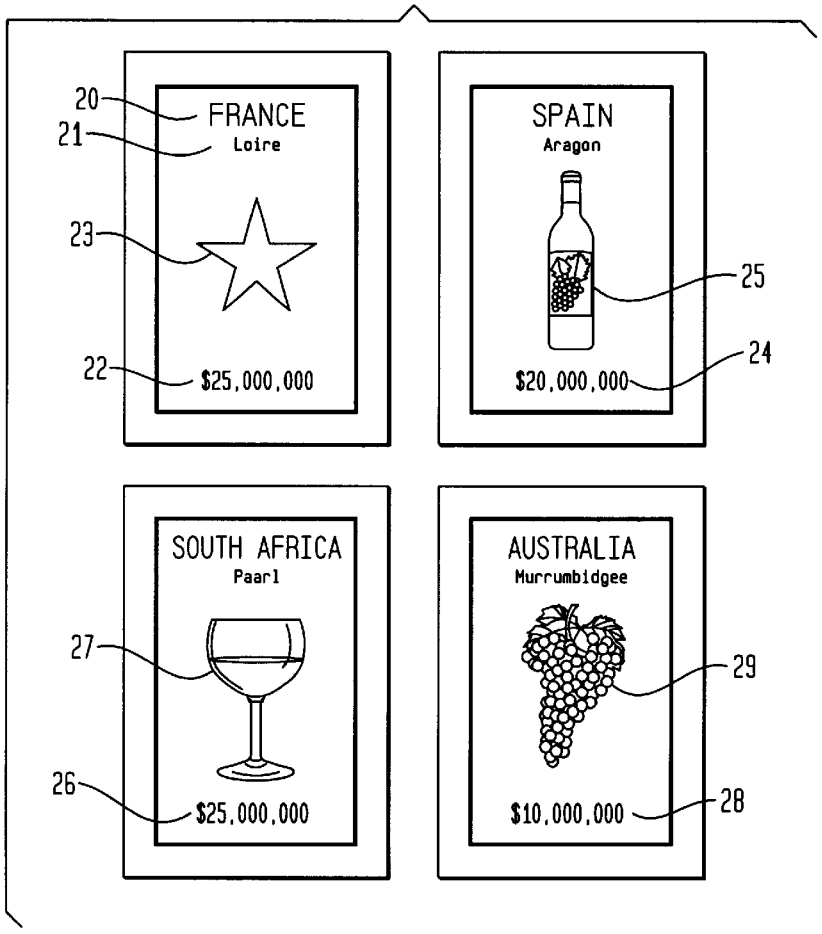
FIG. 2 is a top plan view of the faces of exemplary playing cards each representing a particular principal area and locality shown on the board and each listing one of four purchase prices and their related symbols as used in the embodiment.

The playing cards FIG. 2 list the continent/country of origin 20, the region itself 21, the purchase price 22 (24, 26, 28) and a symbol—a star 23, a bottle 25, a wineglass 27, a bunch of grapes 29—to be assembled for a winning playing card FIG. 2 combination.

Figure 3:
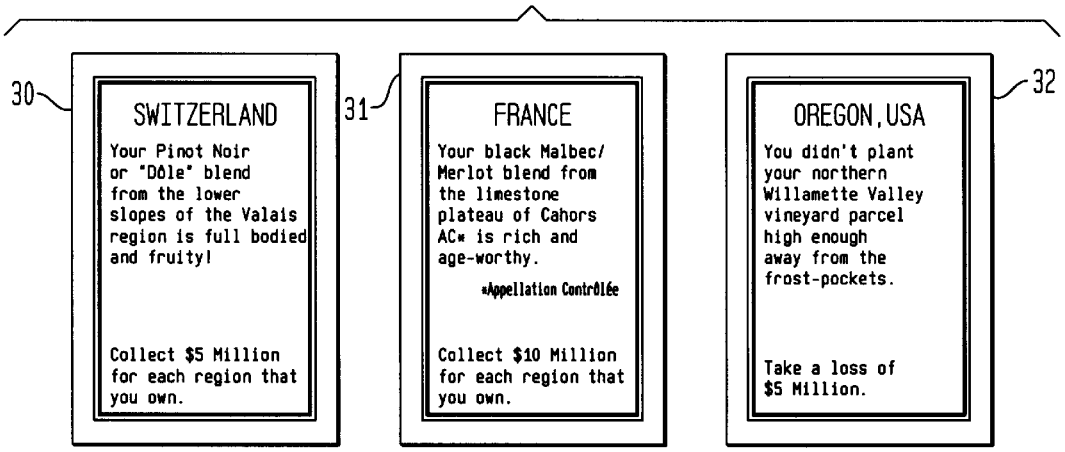
FIG. 3 is a top plan view of the faces of exemplary Chance cards that award game money to players or take it away and that contain wine-related information concerning the principal areas and localities provided in the embodiment.

Chance Cards FIG. 3 reflect wine-related directives for acquiring money 30, 31. There are also Chance Cards FIG. 3 that penalize players 32. The penalties consist of wine-related infractions or problems that afflict those in the wine industry. All penalty payments go into the Kitty Pile 8 on the game board FIG. 1.

Figure 8:
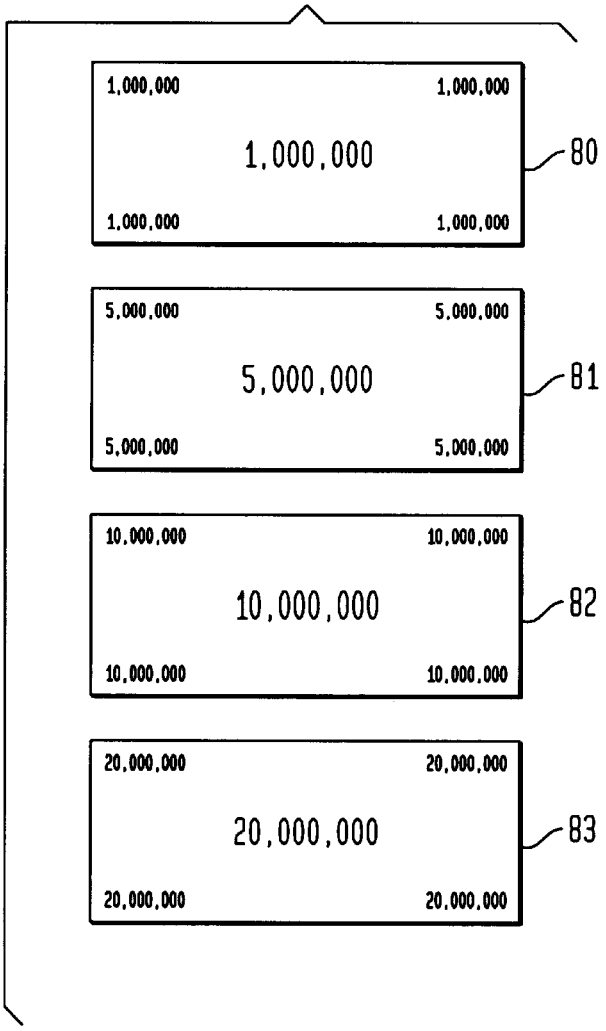
FIG. 8 is a top plan view of the faces of exemplary game money used in the embodiment.

Quiz Cards 40–42 consist of educational questions of varying degrees of difficulty for varying amounts of money FIG. 8, if the answers are correct. If a player's answer to a Quiz card FIG. 4 question is incorrect, he/she does not get the cash award. The most difficult Quiz card 42 questions offer a bonus 43, in addition to the cash award, if the question is answered correctly which is drawing again from the Quiz card FIG. 4 pile.

A turn is two-fold. Step one consists of a player spinning a spinner FIG. 5 that offers four different playing card FIG. 2 instructions. Step two consists of a player rolling a die encased in a sealed wineglass FIG. 6 in order to pick one of the option cards FIGS. 3, 4 or to take any game money FIG. 8 paid to the Kitty Pile 8.

Figure 7:
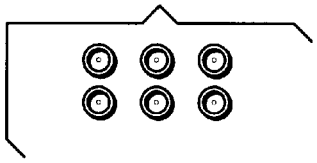
FIG. 7 is a top plan view of examples of colored ownership markers used in the embodiment.

Ownership markers FIG. 7 represent each player by color and indicate region 9 ownership. Once a player has purchased a playing card FIG. 2/region 9, he/she marks the region 9 on the board FIG. 1 and then displays the purchased playing card FIG. 2.

FIG. 8 there is shown a sampling of the various denominations of the game money: 1 million Dollar bills 80; 5 million Dollar bills 81; 10 million Dollar bills 82; 20 million Dollar bills 83.

PLAYING THE GAME

The game is to be played by two or more players with a suggested limitation of six. Each player is equipped with a set of ownership markers FIG. 7 in his/her respective representative color. Each player is also dealt five playing cards FIG. 2 and allocated 35 million Dollars FIG. 8 by the banker. The remaining playing cards FIG. 2 are placed face-down in the middle of the board FIG. 1.

The object of the game is for players to assemble and purchase a winning combination of playing cards FIG. 2 from either inside the continent of Europe 1 or any other continent(s) 2–6 outside of Europe. A player must also be rid of any and all remaining playing cards FIG. 2 in his/her hand. Winning playing card FIG. 2 combinations are defined as: a) 3 stars 23 for $25,000,000 22 each; b) 4 bottles 25 for $20,000,000 24 each or c) 5 wineglasses 27 for $15,000,000 26 each and/or grapes 29 for $10,000,000 28 each. Again, the winning combination rules 7 are posted on the sides of the game board FIG. 1 as a reminder to players. Once a player purchases the playing card(s) FIG. 2 at the end of the two-step turn, he/she marks the region(s) 9 upon the game board FIG. 1 with his/her colored ownership marker(s) FIG. 7. It is beneficial for players to own regions 9 during the course of the game (rather than at the end) in that certain Chance cards 30 reward region owners. Once a player purchases a playing card or cards FIG. 2, he/she displays it/them face-up in front of him/her so that an opponent may purchase one, should the spinner FIG. 5 provide the opportunity during the course of the game.

A turn is two-fold. First, players spin the spinner FIG. 5 which states the following options: a) "draw a playing card FIG. 2 (optional) and/or discard (optional)", b) "discard only (mandatory)"; c) "buy an owned playing card FIG. 2 from another player for half-price (optional)", or d) "pick a desired discard and all discarded since (optional)". All discards remain face-up and in order as discarded.

Figure 4:
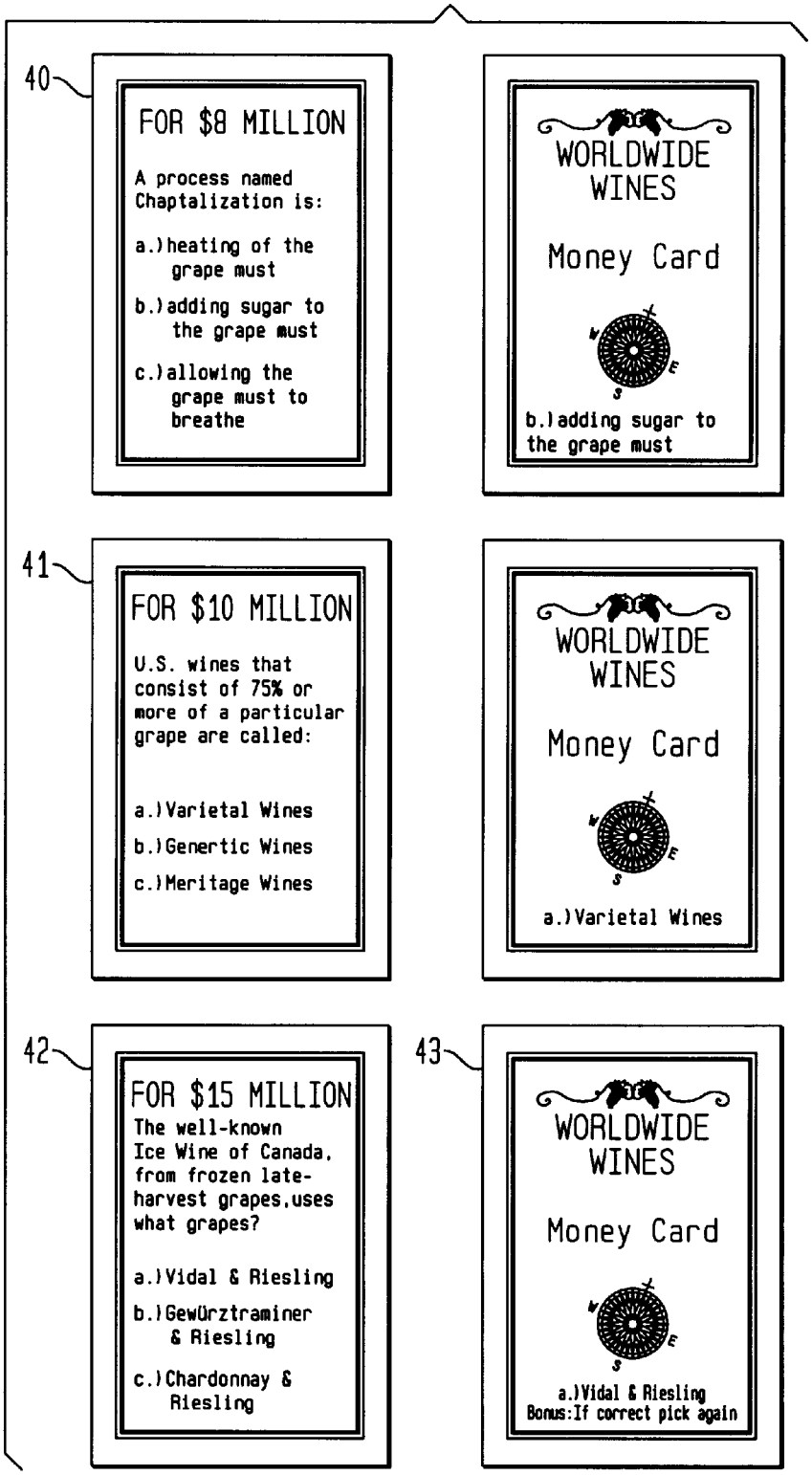
FIG. 4 is a top plan view of the faces and the reverse sides of exemplary Quiz cards that potentially award game money to players and contain wine-related questions and their respective answers concerning the principal areas and localities provided in the embodiment.
Figure 5:
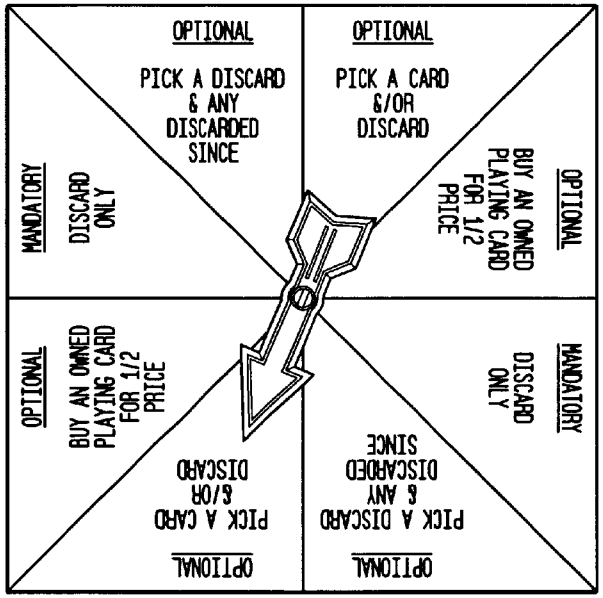
FIG. 5 is a top plan view of an example of the face of the spinner/chance device that determines playing card activity in the embodiment.
Figure 6:
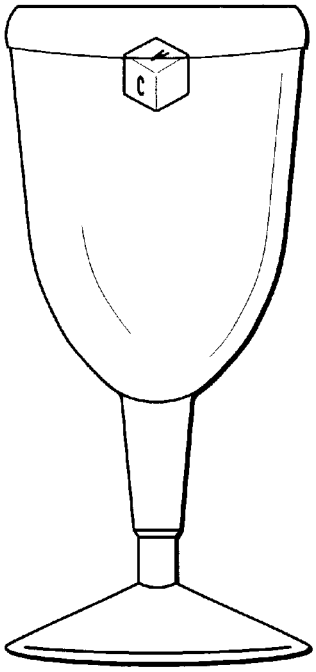
FIG. 6 is a one-dimensional side view of an example of the wineglass/chance device and a perspective view of two sides of a die encased therein that relates to the option cards and the Kitty Pile on the board which, in turn, determine game money activity in the embodiment.

The second part of the turn consists of rolling a die that is encased in a sealed wineglass FIG. 6 (containing red liquid representing wine) by shaking the wineglass FIG. 6. The letters "C", "Q" or "K" printed on the die FIG. 6 direct the player to take either a Chance card FIG. 3, a Quiz card FIG. 4 or the Kitty Pile 8, respectively. Chance cards FIG. 3 award or penalize a player with cash FIG. 8, depending upon the wine-related instructions on the Chance card FIG. 3. Money paid by players FIG. 8 because of penalty Chance cards 32 goes into the Kitty Pile 8 and a player who wins the Kitty Pile 8 via the wineglass chance device/die FIG. 5 takes any money FIG. 8 that is there. The banker replenishes the Kitty Pile 8 with a base amount of 5 million Dollars 81. The Quiz cards FIG. 4 award players money if they answer a Quiz card's FIG. 3 query correctly. The most difficult Quiz cards 42 award a bonus 43 drawing to the player that answers the question correctly, in addition to the cash FIG. 8 award. The more difficult the question, the more money FIG. 8 is awarded. The option cards FIGS. 3–4 are placed on or near the board FIG. 1.

The spinner FIG. 5 is placed on the game board FIG. 1 and offers the playing card FIG. 2 options while the inscribed wineglass die FIG. 6, which is placed on or near the game board FIG. 1, promotes or hinders players' progress in terms of cash FIG. 8. Win or lose, players learn about the many aspects of the wine regions 9 of the world.

Once the two-step turn is taken, a player may then purchase any playing cards FIG. 2 in his/her hand and must mark any owned regions 9 with his/her marker(s) FIG. 7.

In the event that a player must pay a penalty 32, but has no money FIG. 8, he/she must a) sell a playing card or cards FIG. 2 to the bank for half price and pay it to the Kitty Pile 8 or, b) forego the next turn if he/she is unable to pay the penalty at all.

Bid Play: Bid play rules are to be decided prior to beginning the game and requires three players or more.

After the two-step turn a player, who perceives that other players may wish to have one of the playing cards FIG. 2 in his/her hand, may show and offer said playing card FIG. 2 for bid. At least two opposing players must indicate a desire for the playing card FIG. 2. Bidding can then take place. The players write their bid and their name or initials on a piece of paper and place it bid-side-down on the board FIG. 1. The offering player reads the bids aloud and is obligated to take the highest offer. He/she then exchanges the playing card FIG. 2 for cash FIG. 8 from the highest bidder. At this stage of the turn, the offering player may not take the opportunity to buy any playing card(s) FIG. 2 since he/she used the end of the turn to pursue a round of Bid Play. Should a player or players that are solicited to bid not wish to do so (leaving one or no players to bid), bidding will not take place. The offering player may then have the opportunity to buy any playing card(s) FIG. 2 in his/her hand.

In summary, modifications in the design, content and/or form of the embodiment may be carried out during the professional design phase of the present invention and its regional versions without departing from the spirit of the present invention or the scope of the ensuing and related claims. The option cards, Chance and Quiz, as indicated herein will reflect wine-related information applicable to the wine regions with which the game is concerned and upon the occurrence of the game depicting a particular region, its districts and vineyards. The playing cards, upon being applied to a regional version of the present invention, will also be modified to reflect regional districts and their vineyards in addition to the constants: purchase prices and symbols.

What is claimed is:

1. A board game apparatus and a related card game for a number of players designed to educate the players with a number of wine regions or with a single wine region as represented in the form of a map the apparatus and game comprising in combination:

the game board apparatus defining a platform upon which the card game is played;

the map containing a plurality of localities;

each principal area being independent from another principal area and representing either a) an existing international wine-producing continent in the world, or b) an existing district within a major wine region;

the localities within the principal areas representing a) a number of existing wine regions within the continents of the world or b) a number of existing vineyards within the districts of the wine region, depending upon the game version being a) international or b) regional;

each locality on the game board having indicia identifying the locality;

a designated space upon the board termed as a "Kitty Pile";

a plurality of printed winning card combination rules that are posted at each side of the game board;

a supply of game money;

the Kitty Pile providing a means for game money to be held during the course of the game;

a plurality of playing cards that directly correspond to the principal areas and the localities on the game board map;

each playing card listing a purchase price and a symbol in addition to the principal area and the locality it corresponds to on the game board map;

each playing card listing one of four purchase prices that conforms to one of four playing card symbols that comprise in combination:

a star with a first purchase price;

a wine bottle with a second purchase price that is less than the first purchase price;

a wineglass with a third purchase price that is less than the second purchase price;

a bunch of grapes with a fourth purchase price that is less than the third purchase price; and wherein each playing card symbol conforms to one of the printed winning playing card combinations rules that comprise in combination:

three stars; or four wine bottle; or five wine glasses and/or grapes.

2. The game of claim 1 in which each playing card that forms the final winning playing card combination lists and substantially conforms to either a) a predetermined first principal area that is on the game board map, or b) any of the other principal areas outside of the first principal area that are on the game board map.

3. The game of claim 1 additionally comprising:

a plurality of markets that signify playing card/locality ownership;

each marker grouped by colors representative of each player;

a plurality of Chance option cards;

the Chance option cards each containing wine-related information and an instruction affecting each player's game money supply;

a plurality of Quiz option cards;

the Quiz option cards each containing a wine-related question affecting each player's game money supply; and some of the Quiz option cards offering a bonus question.

4. A method of playing a board and card game by a number of players comprising the steps of:

providing a game board apparatus in the form of a wine region-oriented map which defines a platform upon which a card game is played and which is comprised of a plurality of independent principal areas containing a plurality of localities in addition to a Kitty Pile and a set of rules listing a predetermined number of winning playing card combinations posted at each side of the board;

furnishing a plurality of playing cards that correspond directly to the principal areas and the localities on the game board each containing a purchase price and a related symbol; furnishing the playing cards to a designated banker with the banker initially dealing a predetermined number of such cards to each player;

placing the remaining playing cards face-down on the game board for selection and/or discard during the course of the game;

requiring players to pursue one of the winning playing card combinations that must originate either a) inside a predetermined first principal area on the game board map, or b) any other principal area(s) outside of the first principal area on the game board map by purchasing the appropriate playing cards;

supplying a quantity of simulated money to be handled by the designated banker during the course of the game with the banker initially allocating a predetermined amount of the simulated money to each player;

supplying players with a plurality of markers that signify playing card/locality ownership and which are grouped in a color representative of each player;

requiring players to mark a first owned locality on the board map with a first colored representative marker and any second owned localities with second colored representative markers;

furnishing a plurality of Chance option cards containing instructions affecting each player's game money supply and placing the cards on or near the board for drawing purposes; requiring each player that draws a penalty Chance card to deposit a specified amount of game money into a "Kitty Pile" on the board specifically designated for such payments;

requiring a bankrupt player to sell one or more playing cards in order to pay the penalty resulting from one of the penalty Chance cards.

5. The method of claim 4 in which bankruptcy includes the steps of:

selling one or more playing cards to the bank for half price;

paying the appropriate penalty to the Kitty Pile with the money from the playing card sale.

6. The method of claim 5 including the step of requiring the bankrupt player to forego a following turn in the event that the player has no playing cards to sell.

7. The method of claim 4 including the additional steps of:

furnishing a plurality of Quiz option cards containing questions affecting each player's game money supply and placing the cards on or near the board for drawing purposes; permitting each player that answers a bonus Quiz card question correctly to draw another Quiz card; requiring players either to draw one playing card from the board and/or to discard, or to buy one owned playing card from another player;

requiring players to take a second part of the two-step turn which directs players to pick one of the option cards in order to gain or lose game money;

permitting each player to purchase one or more playing cards held by the player at the end of the two-step turn toward attaining one of the winning playing card combinations;

requiring players to place their owned playing cards face-up in front of them in the event that other players have an opportunity and desire to purchase one of the playing cards during the course of the game;

requiring players when discarding to place a discard on the game board face-up and to keep the discards in sequence from first discard to last discard in the event that players have the opportunity and desire to select one of the discards during the course of the game;

determining a winner based upon the player's ownership of one of the winning playing card combinations with the playing cards originating from either a)inside the predetermined first principal area on the map, or b)any other principal area(s) outside of the first principal area on the map.

8. The method of claim 4 may include "Bid Play" which is determined prior to game play and includes the steps of:

requiring more than two and not less than three players to play by Bid Play rules;

permitting each player at the end of the two-step turn the option of offering one particular playing card in his/her hand for sale by bid where at least two opposing players must make an offer for the playing card;

requiring each bidding player to write a secret bid on a piece of paper with his/her name or initials on it and placing the bids face-down on the game board;

requiring the player that offers to sell the playing card to read the bids aloud;

requiring the selling player to accept the highest offer of game money for the playing card;

disallowing the selling player to purchase one or more playing cards in his/her hand at the end of the two-step turn in the event that bidding took place;

permitting the player that solicits the bids to purchase one or more playing cards in his/her hand at the end of the turn should no bidding take place.

9. A method of playing a board and related card game for a number of players comprising the steps of:

providing a game board apparatus in the form of a wine region-oriented map upon which a related card game is played and which contains a plurality of principal areas which in turn contain a plurality of localities;

providing a plurality of playing cards that are initially dealt to each player and which correspond directly to the principal areas and the localities on the game board with each playing card containing a particular symbol that corresponds to a predetermined number of winning playing card combinations posted on the game board;

requiring each player to pursue one of the winning playing card combinations which must originate from either a) inside a predetermined first principal area on the game board map or b) any other principal area(s) outside of the first principal area on the game board map by purchasing the appropriate playing cards;

requiring each player to take a two-step turn which consists of spinning a chance device that relates to acquiring or discarding playing cards and shaking a chance device that relates to gaining or paying out cash;

permitting each player to purchase one or more playing cards in his/her hand at the end of the two-step turn towards attaining one of the winning playing card combinations;

determining a winner based upon the player's ownership of one of the winning playing card combinations with all cards originating from either a) inside the predetermined first principal area or b) any other principal area outside of the first principal area;

permitting each player to enter into "Bid Play" at the end of the two-step turn if the game has been determined to include Bid Play rules prior to commencing play;

the Bid Play rules comprising the steps of:

requiring more than two and not less than three players to play by Bid Play rules;

permitting each player at the end of the two-step turn the option of offering one particular playing card held by the player for sale by bid where at least two opposing players must make an offer for the playing card;

requiring each bidding player to write a secret bid on a piece of paper with his/her name or initials on it and placing the bids face-down on the game board;

requiring the player that offers to sell the playing card to read the bids aloud;

requiring the selling player to accept the highest offer of game money for the playing card;

disallowing the selling player to purchase one or more playing cards held by the player at the end of the two-step turn in the event that bidding took place; and permitting the player that solicits the bids to purchase one or more playing cards in his/her hand at the end of the turn should no bidding take place.

* * * * *